United States Patent [19]

Wilson

[11] Patent Number: 4,457,433

[45] Date of Patent: Jul. 3, 1984

[54] KEY LOCK FOR PLASTIC RECEPTACLES

[76] Inventor: James D. Wilson, 421 Vista Suerte, Newport Beach, Calif. 92660

[21] Appl. No.: 462,540

[22] Filed: Jan. 31, 1983

[51] Int. Cl.[3] ..... B65D 21/04

[52] U.S. Cl. ..... 206/505; 206/507

[58] Field of Search ..... 206/505, 507

[56] References Cited

U.S. PATENT DOCUMENTS 3,405,810 10/1968 Rogus ..... 206/507
4,007,839 2/1977 Stahl ..... 206/505
4,093,070 6/1978 Stahl ..... 206/507
4,402,408 9/1983 Kreeger ..... 206/507

*Primary Examiner*—George E. Lowrance
*Attorney, Agent, or Firm*—Keith D. Beecker

[57] ABSTRACT

A key lock for nestable/stackable plastic receptacles for use, for example, in the bakery industry, so that the receptacles are not interchangeable between competing bakeries. The key lock takes the form of a molded projection and mating slot in one or more of the interacting lugs of the receptacles at positions which vary from one bakery's receptacles to another.

2 Claims, 2 Drawing Figures

KEY LOCK FOR PLASTIC RECEPTACLES

BACKGROUND OF THE INVENTION

The key lock of the present invention is particularly adapted to be used in conjunction with nestable/stackable plastic receptacles of the type described in U.S. Pat. Nos. 4,308,954 and 4,334,616.

As described, for example, in U.S. Pat. No. 4,308,954, receptacles are available each of which is constructed so that it may be stacked on other like receptacles when filled with products, or nested down into like receptacles when empty so as to conserve space. The receptacles described in the patent are intended primarily for use in the food industry, although they have general application in a wide variety of plants, warehouses, transportation vehicles and the like.

The receptacles may be used, for example, in transporting and displaying bakery, or other goods. For example, a plurality of the receptacles may be loaded with bakery goods at the bakery and stacked on top of one another, and they may then be transported in a stacked condition to the retail store or market. The stacked receptacles may then be positioned on the floor of the store or market so that the merchandise in the receptacles may be displayed to the purchasing public. When the receptacles are empty, they may be nested down into one another for space conservation purposes, and then returned to the bakery.

The particular nested and stackable receptacles described in the aforesaid patents are advantageous in that they are capable of being nested or stacked without the need for moving bails or other movable parts. As described in the patents, the receptacles are stacked on one another by means of interacting lugs at the top and bottom edges of each receptacle.

Many bakeries are concerned that their receptacles may be pirated and used by other bakeries in conjunction with the other bakeries' receptacles of like kind. The key lock of the present invention provides a simple means whereby the receptacles can be used only in conjunction with the receptacles from the same bakery and cannot be intermixed with the receptacles from other bakeries.

BRIEF DESCRIPTION OF THE DRAWING

FIG. 2 is a fragmentary perspective view showing the manner in which the key lock is mounted on interacting lugs of the receptacle of FIG. 1.

DETAILED DESCRIPTION OF THE ILLUSTRATED EMBODIMENT

Figure 1:
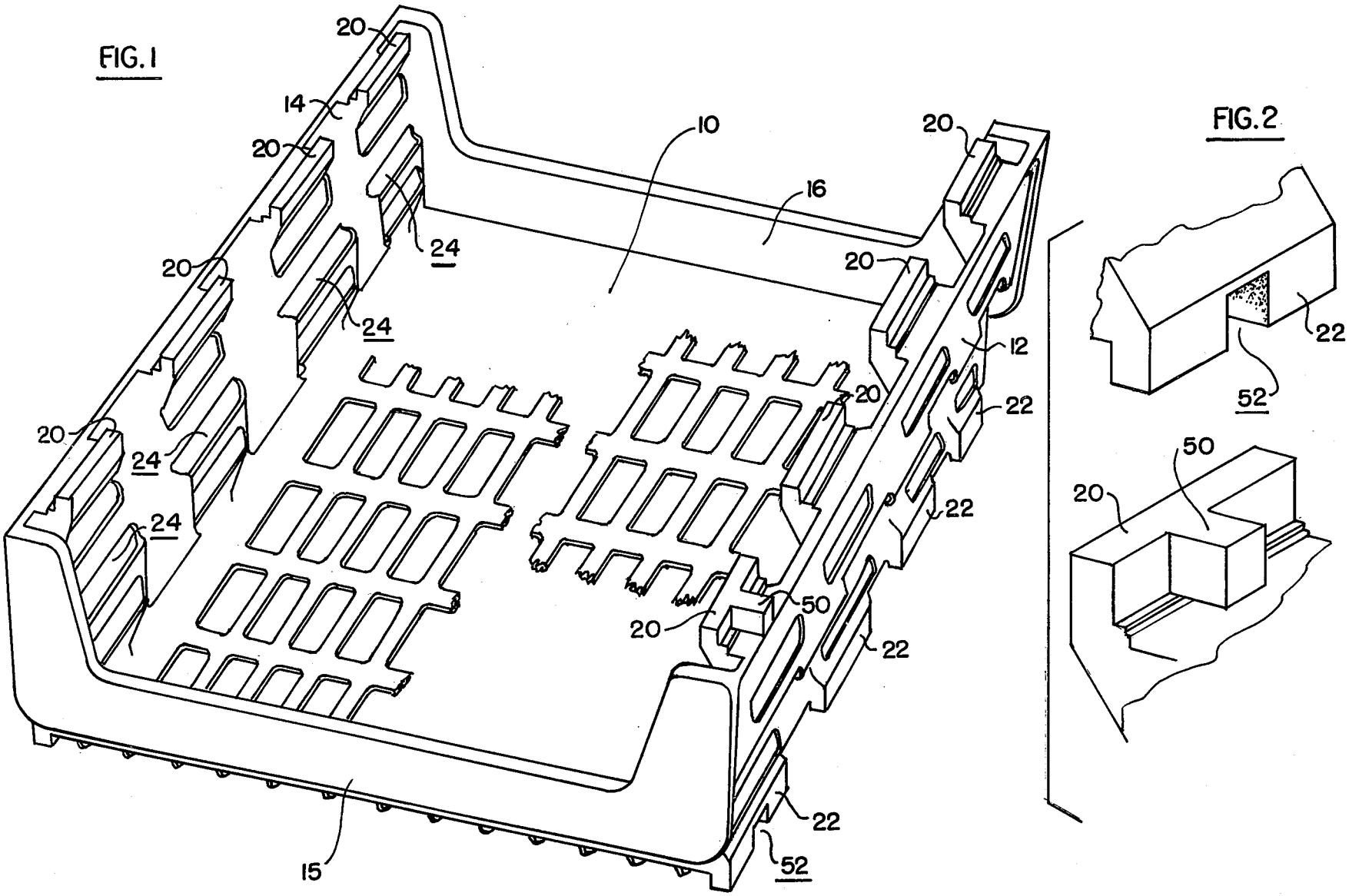
FIG. 1 is a perspective representation of a receptacle constructed in accordance with the teachings of U.S. Pat. No. 4,308,954, and including the key lock of the present invention.

The receptacle shown in FIG. 1 is formed, for example, of molded plastic, such as injection molded polypropylene. The receptacle is capable of being stacked with other like receptacles into a rigid and stable tier; and of being nested within the like receptacles, also as a rigid and stable tier.

The receptacle, as shown in FIG. 1, includes a bottom 10, a pair of side walls 12 and 14 integral with the bottom, and end walls 15 and 16 integral with the bottom and joining the side walls, the end walls being of reduced height as compared with the side walls to permit access to the receptacle when other like receptacles are stacked on top of it.

The side walls 12 and 14 each have nesting and stacking means formed on the inner and outer surfaces thereof. The stacking means comprises a plurality of upwardly extending lugs 20 formed along the top edge of each side wall, and extending along the edges in spaced relationship with one another. The lugs 20, in each instance, are displaced inwardly from the plane of the corresponding side wall. The stacking means further comprises a like plurality of downwardly facing lugs 22 formed at the lower edge of each side wall 12 and 14, the latter lugs being vertically aligned with corresponding ones of the lugs 20.

The receptacle of FIG. 1 may be stacked on top of other like receptacles, or nested down into other like receptacles, in a manner fully described in U.S. Pat. No. 4,308,954.

In accordance with the present invention, a projection 50 is molded into one or more of the upper lugs 20, as shown in FIGS. 1 and 2. The position of projection 50 would normally be in center of one or more of upper lugs 20, but would appear in different lugs for different bakeries. No two bakeries would have the same combinations.

The corresponding lower lug 22 has a slot 52 formed in it in position to receive the lug 50 when the receptacle of FIG. 1 is stacked on top of a like receptacle. It will be appreciated that the lugs 50 and slots 52 may be formed on one or more of pairs of the lugs 20 and 22 of the receptacle of FIG. 1.

Using the construction shown in the drawing and described above, the receptacles of FIG. 1 are constructed to be used only in conjunction with other receptacles whose lugs 50 and slots 52 have the same position as the elements shown in the drawing. Also, the positions of the lugs 50 and slots 52 are changed from one bakery to another, so that the receptacles cannot be used interchangeably.

The invention provides, therefore, an improved and simplified key lock which prevents the receptacles of any particular source from being used in conjunction with the receptacles from another source.

It will be appreciated that while a particular embodiment of the invention has been shown and described, modifications may be made. It is intended in the claims to cover all modifications which come within the spirit and scope of the invention.

What is claimed is:

1. A key lock for use with receptacles adapted to be stacked and nested with one another, each receptacle including a pair of side walls, a plurality of discrete upwardly extending lugs formed along the upper edge of each of the side walls and extending therealong in spaced relationship with respect to one another, each upwardly extending lug being displaced inwardly from the plane of the corresponding side wall, and each upwardly extending lug having an outwardly facing vertical planar surface, and a corresponding plurality of discrete downwardly facing lugs formed on the lower edge of each of the side walls in respective vertical alignment with the upwardly extending lugs to be received on said upwardly extending lugs of a like receptacle when the first-mentioned receptacle is stacked on top of the like receptacle, each of the downwardly extending lugs of the first-mentioned receptacle having a vertical front wall with an inner vertical planar surface engaging the vertical planar surface of the corresponding upwardly extending lug of the like receptacle, a key lock comprising: a projection formed on one of said upwardly extending lugs and extending transversely outwardly from the vertical planar surface thereof with the top of said lug being coplanar with the top of the corresponding upwardly extending lug, and the downwardly extending lug of the like receptacle which interacts therewith having a slot in the front wall thereof in position to receive said projection.

2. The key lock defined in claim 1, in which said receptacles are formed of a plastic material, and said projection is molded into the corresponding lug.

* * * * *